US005664271A

United States Patent [19]

Bellavance

[11] Patent Number: 5,664,271

[45] Date of Patent: Sep. 9, 1997

[54] SUPPORT PILLOW ASSEMBLY

[76] Inventor: Joseph M. Bellavance, 93A Neal St., Portland, Me. 04102

[21] Appl. No.: 449,711

[22] Filed: May 24, 1995

[51] Int. Cl.[6] ..... A47C 20/00

[52] U.S. Cl. ..... 5/632; 5/630; 5/631; 5/648; 5/652

[58] Field of Search ..... 5/630–632, 640, 5/648, 652, 657; D6/601, 596

[56] References Cited

U.S. PATENT DOCUMENTS

| | | | |
|---|---|---|---|
| D. 230,804 | 3/1974 | Lijewski | D6/601 |
| D. 308,788 | 6/1990 | Boehm | D6/601 |
| D. 310,608 | 9/1990 | Axell | D6/601 |
| D. 342,856 | 1/1994 | Hagen | D6/601 |
| 4,288,879 | 9/1981 | Pate | 5/431 |
| 4,397,052 | 8/1983 | Lund, III | 5/431 |
| 4,506,396 | 3/1985 | Ritchie, Jr. | 5/930 |
| 4,584,730 | 4/1986 | Rajan | 5/431 |
| 4,624,021 | 11/1986 | Hofstetter | 5/431 |
| 4,736,477 | 4/1988 | Moore | 5/443 |
| 4,754,510 | 7/1988 | King | 5/431 |
| 4,794,657 | 1/1989 | Avery | 5/431 |
| 5,117,522 | 6/1992 | Everett | 5/648 |
| 5,154,649 | 10/1992 | Pender | 5/652 |
| 5,182,828 | 2/1993 | Alivizatos | 5/632 |
| 5,216,771 | 6/1993 | Hoff | 5/648 |
| 5,269,322 | 12/1993 | Mandel | 128/845 |
| 5,269,323 | 12/1993 | Krouskop | 128/845 |
| 5,418,991 | 5/1995 | Shiflett | 5/648 |

FOREIGN PATENT DOCUMENTS

| | | | |
|---|---|---|---|
| 328577 | 4/1930 | United Kingdom | 5/640 |

OTHER PUBLICATIONS

"Domestications" Spring 1995, pp. 80 & 81.
"The Company Store" Summer 1995.

*Primary Examiner*—Steven N. Meyers
*Assistant Examiner*—Tuyet-Phuong Pham
*Attorney, Agent, or Firm*—Jones, Tullar & Cooper, P.C.

[57] ABSTRACT

A support pillow assembly is usable for cushioning the body of a person while the person is lying on his/her side on a mattress and includes an abdominal support pillow adapted to partially underlie the person's abdomen and a leg support pillow adapted to be positioned between the person's legs. The leg support pillow can be two pillows interconnected by flap structures. Alternately, the two leg pillows can be combined into a single leg support pillow.

8 Claims, 2 Drawing Sheets

FIG. 1
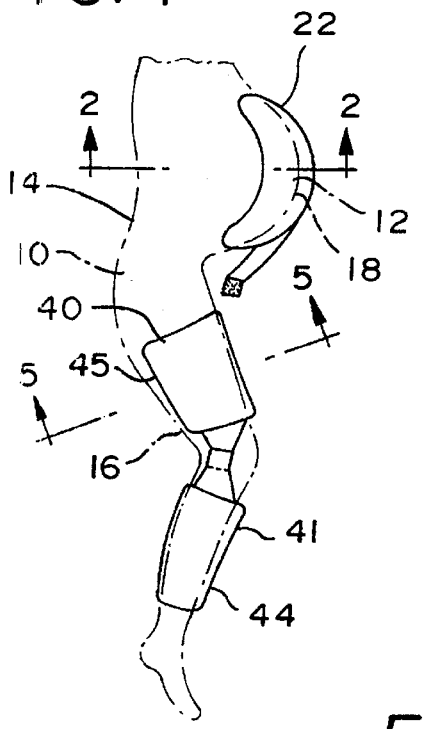
FIG. 2
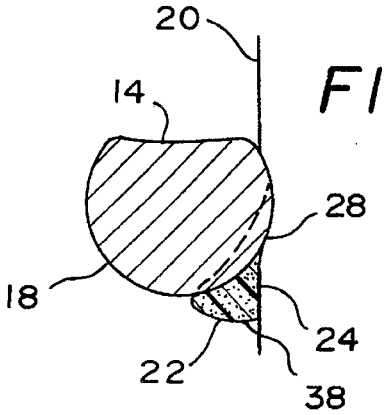
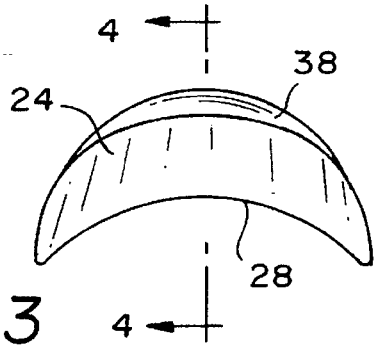
FIG. 3
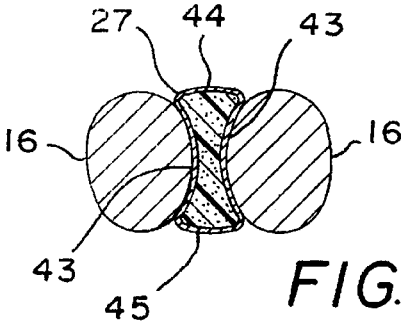
FIG. 5
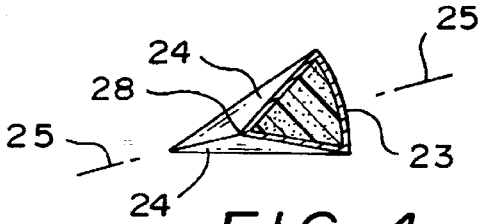
FIG. 4
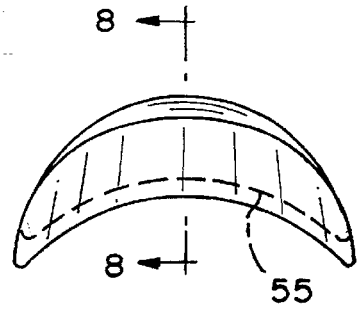
FIG. 7
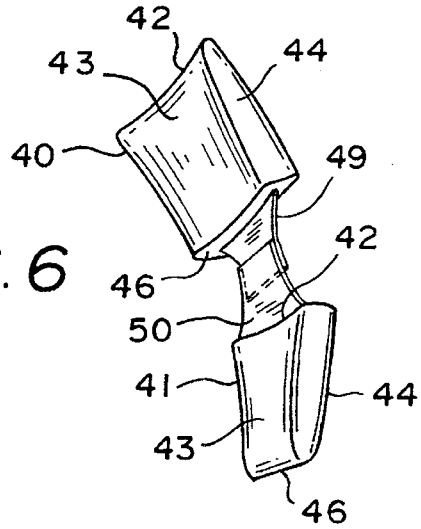
FIG. 6
FIG. 8
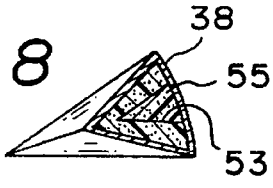

SUPPORT PILLOW ASSEMBLY

FIELD OF THE INVENTION

The present invention is directed generally to a support pillow assembly for a person's body. More particularly, the present invention is directed to a support pillow assembly designed to enhance comfort when a person is lying on their side during resting or sleeping. More specifically, the present invention is directed to a support pillow assembly which includes an abdominal support which is designed to underlie the abdominal area of the person and a leg support positionable between the user's legs. A thigh support pillow is adapted to extend between the thigh areas of the person's legs. A calf support pillow is designed to extend between the calf areas of the person's legs. The thigh and calf support pillows can be combined into a single leg support pillow.

DESCRIPTION OF THE PRIOR ART

The use of specially designed pillows for making a pregnant woman more comfortable while lying on her side on a mattress is generally known in the prior art.

U.S. Pat. No. 4,288,879 to J. L. Pate shows a wedge-shaped abdominal support pillow having a straight front edge adapted for insertion underneath the woman's abdomen while she is lying on her side. The upper surface of the pillow has a concave spherical configuration that conforms to the shape of the woman's abdomen, whereby the pillow provides abdominal support.

U.S. Pat. No. 4,397,052, to R. Lund shows an abdominal support pillow having approximately the same shape as the pillow in the Pate patent. The Lund patent additionally shows a back rest detachably attached to the abdominal support pillow, whereby the woman's body has a cradle-type support between the abdominal support pillow and the back rest.

U.S. Pat. No. 4,736,477, to G. Moore, shows a flat slab-like pillow construction adapted for positionment between the knees of a person, while he or she is resting or sleeping on a mattress. The pillow has a V notch in one edge, and a series of slits in the other edge, whereby the pillow can be bent into a buckled configuration, e.g., when the person is lying on his or her side with the legs in a bent or curled configuration.

U.S. Pat. No. 4,584,730, to E. Rajan, shows a flat slab-like pillow having a number of protrusions that can be used as legs to space the slab-like pillow above the mattress surface. A person lying on his/her side can have one leg resting on the mattress (underneath the pillow) and the other leg resting on the upper surface of the pillow.

U.S. Pat. No. 5,117,522, to P. Everett, shows a pillow adapted for positionment between a person's legs while the person is lying on his or her back, on a mattress. The pillow has an I-beam cross section to keep the pillow in place; also, flexible straps can be attached to the pillow for extension around the person's legs, thereby further ensuring good retention of the pillow between the person's legs. The pillow has a transverse triangular notch that forms a hinge connection between two sections of the pillow, whereby the person can bend or straighten his/her legs without changing the fit of the pillow between the legs.

The prior art provides pillow structures that offer at least partial cushioning and support for a person's abdomen and legs while the person is lying on a mattress. A person who is pregnant or who has medical problems, e.g. hip problems, lumbar problems, knee conditions, sacroiliac problems or arthritic conditions, can be made more comfortable while lying in bed

SUMMARY OF THE PRESENT INVENTION

The object of the present invention is to provide a support pillow assembly that is usable to make a person, e.g., a pregnant woman or a person with a medical condition, more comfortable while the person is lying on his/her side on a mattress, while the person is resting or sleeping.

The support pillow assembly in accordance with the present invention has essentially two components, an abdominal support and a leg support. These components can be used in concert or separately, and the leg support can be made either as one piece or two connected and separable pieces. A first one of the pillows of the support pillow assembly, the abdominal support is crescent-shaped so as to be positionable under the enlarged abdomen of the pregnant woman or obese person, whereby the abdomen is at least partially supported against the abdominal strains associated with pregnancy or with an obese condition. A second pillow, the leg support, has an essentially flat elongated shape so that it can be located between the person's legs, to prevent chafing of the thighs and calves, and to better distribute the weight of the uppermost leg onto the lowermost leg (i.e., the leg in contact with the mattress). Also, this second pillow or pillows serve to alleviate lower back and pelvic pain by reducing pressure on the lower back and pelvis.

The second, leg support pillow can comprise a single C-shaped pillow extending from the person's thigh area to the calf area. Alternately, the second, leg support-pillow-can comprise a separate upper, thigh support pillow extendable between the person's thighs, and a separate lower, calf support pillow extendable between the person's calves. The two pillows can be connected together by flexible flaps that extend from the pillow covers, such that the thigh support pillow and calf support pillow are usable as a unit for leg cushioning purposes.

Each pillow in the support pillow assembly of the present invention may comprise a resilient foam core or body and a fabric cover encapsulating or enveloping the foam body. Each fabric cover may include a zipper structure, whereby the cover can be removed from the foam body for cleaning or washing purposes.

The support pillow assembly in accordance with the present invention is designed for use by pregnant women and by obese persons who may experience leg pain, pelvic pain, and/or back pain while lying on a mattress. The leg support pillow can relieve pressures on the person's lumbar spine, sacroiliac joint, and sciatic nerve.

When a person is lying on his or her side, the person's lumbar spine sidebends away from the mattress. By placing the cushions between the person's legs, the lumbar spine is maintained in a more neutral position.

Also, when a person is lying on his/her side and the hip is adducted past neutral, the iliotibial band may be stretched, thereby exerting a downward pull on a person's pelvis. When the leg support pillow or pillows are placed between the person's legs, the top leg is abducted a slight amount, thereby reducing pull on the iliotibial band and reducing the pelvic stress. The leg support reduces stress on the iliolumbar and posterior sacroiliac ligaments by maintaining a more neutral lumbopelvic position.

In some cases, the sciatic nerve can become pinched between the piriformis and superior gemellus muscles, thereby radiating pain into the leg. By placing the leg support pillow or pillows between the person's legs, the piriformis and superior gemellus muscles are on slack, thereby reducing the risk of sciatic nerve stress.

The abdominal support pillow is advantageous in that when a pregnant woman or obese person is sidelying, this pillow prevents the enlarged abdomen from straining the abdominal musculature pregnant women,;overweight adults, and sufferers of lower back pain and/or pelvic pain can use the support pillow assembly of the present invention to rest and sleep more comfortably.

BRIEF DESCRIPTION OF THE DRAWINGS OF THE PRESENT INVENTION

Various features and advantages of the invention will become apparent from the attached drawings of a representative embodiment of the invention.

FIG. 1, shows a first preferred embodiment of the support pillow assembly of the present invention in place on the body of a pregnant woman positioned lying on her side on a mattress (not shown), and is a top plan view;

FIG. 2, is a transverse sectional view, taken on line 2—2 in FIG. 1;

FIG. 3, is an enlarged top plan view, of a crescent-shaped abdominal support pillow of the present invention;

FIG. 4, is a transverse sectional view, taken on line 4—4 in FIG. 3;

FIG. 5, is a transverse sectional view, taken on line 5—5 in FIG. 1;

FIG. 6, is a perspective view of the leg support pillow consisting of two connected leg support pillows, as depicted in the first preferred embodiment of the support pillow assembly;

FIGS. 7 and 8, are views taken in the same directions as FIGS. 3 and 4, but illustrating an alternate abdominal support pillow configuration;

DESCRIPTION OF THE PREFERRED EMBODIMENTS OF THE PRESENT INVENTION

Figure 9:
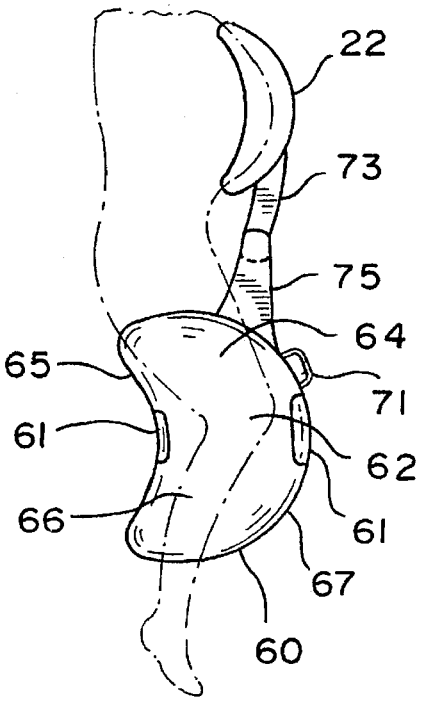
FIG. 9, is a top plan view of a second preferred embodiment of the support pillow assembly and showing a leg support pillow structure, wherein the two leg supports are integrally joined together.

Referring initially to FIG. 1, there may be seen generally a first preferred embodiment of a support pillow assembly in accordance with the present invention. This support pillow assembly includes an abdominal support 22 insertable underneath the user's enlarged abdomen. The abdominal support 22 is designed to relieve the abdominal musculature strain associated with an enlarged abdomen. The abdominal support cushion 22 may or may not be used in conjunction with a leg support 40 and 41, which is positionable between a user's legs and extends between the thigh and calf portions of a user's legs. Leg support 40 and 41 is designed to support a person's legs in a spaced-apart configuration while a user is lying on his or her side to relieve lumbopelvic strain. The leg support shown in FIG. 1 includes the upper, thigh support pillow 40 and the lower, calf support pillow 41. These may be individual, connectable pillows as shown in FIG. 1. FIG. 9 depicts an alternative, single-piece embodiment 60 of the leg support, which is also releasably connected to abdominal support 22.

FIG. 1 shows, in dashed lines, the body 10 of a pregnant woman in a position lying on her side on a mattress. As will be apparent, the pregnant woman has an enlarged, generally bulbous, abdomen 12, back 14, and legs 16. FIG. 2 is a transverse sectional view showing the woman's back 15, and the generally spherical abdomen having a front surface 18 overlying the surface 20 of a conventional mattress.

The present invention is concerned, in part, with a crescent-shaped abdominal support pillow 22 formed of foam rubber or similar soft resilient material. The pillow can be formed of a Single density foam material; alternatively the pillow can include a core of high density foam material, and an outer layer of a lower density foam material. The pillow is preferably equipped with a removable cover 23, as shown in FIG. 4, over the foam body. This cover may be made using an inner waterproof nylon cover and an outer cover. Alternatively the cover may be a single cover made of a cotton or flannel material. It is also to be noted that all the pillows in the present invention may have removable covers.

The abdominal support pillow 22 has a generally wedge-shaped cross-section, as seen, e.g. in FIG. 4. The pillow 22 comprises a relatively thin arcuate concave inner edge 28 adapted to lie on the mattress surface 20 in partial encirclement of the abdomen, and a relatively thick arcuate convex outer edge 38 adapted to extend generally from the mattress, as seen in FIG. 2.

The abdominal support pillow 22 includes two major faces 24 that are convergent from the thick arcuate edge 38 to the thin arcuate edge 28. These two major faces 24 are symmetrical around an imaginary midplane 25 extending through arcuate edges 28 and 38, as shown generally in FIG. 4. The symmetry of major faces enables the pillow to be positioned with either face 24 presented to the abdominal surface.

As indicated previously, the arcuate nature of edge 28 enables the thinner areas of the pillow to extend around and underneath the person's abdomen, without undue effort on the person's part. As the weight of the abdomen presses downwardly, the pillow deflects so that the lowermost face 24 seats against mattress surface 20.

Referring to FIGS. 1, 5 and 6, there is shown a leg support positionable between the users legs. This leg support includes an upper thigh support pillow 40 adapted to be positioned between the thighs of the person's legs, and a lower, calf support pillow 41 adapted to be positioned between the calf areas of the person's legs. These pillows act as spacers to prevent chafing of the skin, and also to improve the weight distribution of the uppermost leg onto the lowermost leg. Also, these pillows serve to alleviate low back pain by reducing low back and pelvic stress. As shown in FIG. 5, thigh support pillow 40 has two concave arcuate side surfaces 43 extending between a relatively narrow front edge 44 and a relatively narrow rear edge 45. The concave arcuate side surfaces 43 conform to the facing surfaces of the person's thighs so as to increase the support surface area, and thereby enhance the comfortability factor. Also, the transverse thickness dimension of the thigh support pillow 40 increases slightly from the upper end 42 to the lower end 46. The aim of the pillow design is to make the pillow conform generally to the anatomy of the person using the pillow.

The cross sectional configuration of the lower, calf support pillow 41 is similar to that shown in FIG. 5, such that the two pillows 40 and 41 work together as a leg support to enable the person to be reasonably comfortable while lying on his/her side on the mattress. Pillow 41 has a cross section that tapers slightly from its upper edge 42 to its lower edge 46, to better conform to the human anatomy calf area.

Each pillow 40 or 41 comprises a resilient foam body and a fabric covering fitting around the foam body. Zipper mechanisms can be incorporated into the fabric coverings to permit removal of the coverings for cleaning purposes. In FIG. 5 a representative fabric covering is designated by numeral 27.

The concave nature of pillow side surfaces 43 (on pillows 40 and 41) is advantageous in that it helps to retain the respective pillow in place between the person's legs. However, additional restraint can be provided by means of VELCRO straps extendable around one of the person's legs, in a configuration similar to the configuration depicted in aforementioned U.S. Pat. No. 4,736,477 to G. Moore or U.S. Pat. No. 5,117,522 to P. Everett. Each VELCRO strap would be attachable to the pillow covering.

Pillows 40 and 41 are connectable together by a flexible connection means that comprises a flexible flap 49 extending from the fabric covering for thigh pillow 40, and a second flexible flap 50 extending from the fabric covering for calf pillow 41. Each flap comprises a releasable fastener formed e.g. preferably of a hook/loop fibrous material marketed under the trade name VELCRO. When the flaps are overlapped and pressed together the patches adhere together, so that the flaps cooperatively hold pillows 40 and 41 against undesired shifting or dislocation. It should be noted that the use of the terms "flap", "flaps", "flexible flap(s)", "flap structures", are all referring to the same releasable "flexible connection means", such as, for example, snaps, hook and loop, or buttons, and are used interchangeably throughout.

FIGS. 7 and 8 show an abdominal support pillow that has the same external configuration as the pillow shown in FIGS. 1 through 4. However, the pillow of FIGS. 7 and 8 has a cavity 53 in its peripheral edge surface 38 designed to receive a resilient insert 55. Insert 55 can be formed of the same foam material as the pillow, such that when the insert 55 is positioned within the cavity (as shown in FIG. 8) the pillow functions in essentially the same fashion as the FIG. 1 pillow.

Foam material insert 55 can be removed from cavity 53 to enable the pillow to have a shallower external upper surface 24. The roof surface of cavity 53 folds down onto the floor surface of the cavity so that the wedge angle of the pillow underneath the person's abdomen is reduced.

The wedge-shaped insert 55 may be removed from the cavity 53 during those times when the person's abdomen is larger, i.e. during the later stages of pregnancy or at any time desired by the user to maximize comfort.

When the abdomen becomes fully enlarged, as shown in FIG. 1, the insert 55 will be removed from cavity 53 to provide a shallower pillow construction conforming to the enlarged abdominal condition.

The abdominal support pillow of FIGS. 1 through 4, 7 and 8, are designed particularly for use by pregnant women. However, such pillows can also be used by obese people having large abdomens.

FIGS. 9 to 12 show a second preferred embodiment of a support pillow assembly in accordance with the present invention. In this second preferred embodiment, a single leg support pillow structure 60 is utilized to perform the support functions of the two leg support pillows 40 and 41 shown in FIGS. 1, 5 and 6.

As shown in FIGS. 9–12, the single leg support pillow 60 has a length sufficient to span the distance from the person's midthigh area to the midcalf area. The leg support pillow 60 is formed of a relatively soft resilient material, e.g., foam rubber having a cloth covering, such that the pillow can provide a resilient support action for the person's leg that is remote from the mattress surface 20. Two pedestals 61 support the slab-like pillow in spaced relation to mattress surface 20, whereby the person can have one leg resting on the mattress underneath the pillow; with the other leg resting on the upper surface of the pillow.

Pedestals 61 are located at intermediate points along the length dimension of the leg support pillow 60, so that the areas of the leg support pillow 60 interposed between the person's thigh areas and calf areas are somewhat flexible and conformable to the person's anatomy. Also, the central area of the leg support pillow 60, where the person's knee is located, is somewhat thicker than the pillow areas in contact with the thighs and calves.

The central midportion of the leg support pillow 60, designated by the numeral 62, accommodates the person's knees without causing them to spread apart to an uncomfortable extent. The thigh support area 64 is tapered from the central, knee area 62 to provide adequate spacing and cushioning of the person's thighs. Similarly, the calf support area 66 is tapered from central, knee area 62 to provide the desired resilient calf support action.

The leg support pillow 60 of FIGS. 9–12 has a sufficient face area so that the person can move his/her legs between bent and straight conditions without loss of the desired leg support action. In use of the pillow the two pedestals 61 normally support the slab-like pillow above the mattress surface. However, if the person's legs should be thicker than the pedestal height, then the pedestals 61 can lift from the mattress surface without adverse effect on the pillow support action. Pedestals 61 also provide the function of preventing the pillow from slipping from between person's legs while he or she is lying with one side on the mattress. Another pedestal purpose is to prevent the pillow from "over-rotating", or "over-tilting" backwards or forwards, if one leg is significantly in front of the other.

Figure 10:
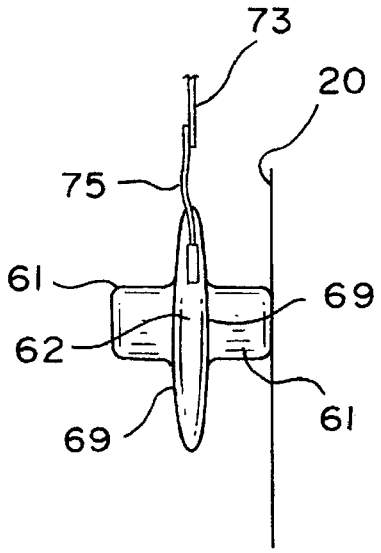
FIG. 10, is a partial right edge view of the FIG. 9 pillow structure.
Figure 11:
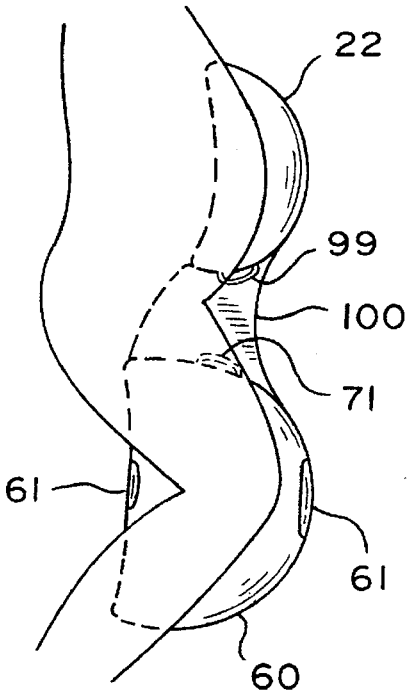
FIG. 11 is a view similar to FIGS. 1 and 9 and showing an alternative pillow connecting structure.

As shown in FIGS. 9 and 11, the leg support pillow 60 has a C-shaped plan configuration defined by a concave arcuate rear edge 65 and a convex arcuate front edge 67. The resilient pillow body has two essentially flat major faces 69 which converge as they approach edges 65 and 67. However, as shown in FIG. 10, major faces 69 are gradually convergent (tapered) from the central midportion 62 to the upper and lower edge areas of the pillow body, matching the tapering in the two-piece pillow set. The gradual convergence is designed to conform the pillow structure generally to the human anatomy, whereby the person's knee will be spread apart to a desired extent, consistent with a comfortable positionment of the pillow between the person's legs.

Pedestals 61 are duplicated on both major faces of the pillow, such that the pillow can be reversed so that arcuate front edge 67 can face to the right or to the left; the person can lie on his/her right side or left side. The C-shaped configuration of the pillow enables the person to move his/her legs between the straight and bent conditions. At the same time the pillow has a relatively small mass so that it can be manipulated without undue effort. A handle 71 can be sewn to the front edge of the pillow cover to facilitate manual manipulation of the pillow. A similar handle 99 can be sewn into the abdominal support pillow cover. Such a handle 99 can be seen in FIGS. 11 and 12.

As shown in FIG. 9, flexible fabric flaps 73 and 75 are sewn to the covers for the abdominal support pillow 22 and the leg support pillow 60, whereby the two pillows are connected together, to prevent pillow dislocation or shifting. The two flaps have releasable fasteners on their overlapped surfaces, so that when the patches are pressed together the flaps are secured together. The releasable fasteners can be formed of the fibrous hook and loop materials marketed under the tradename VELCRO.

Figure 12:
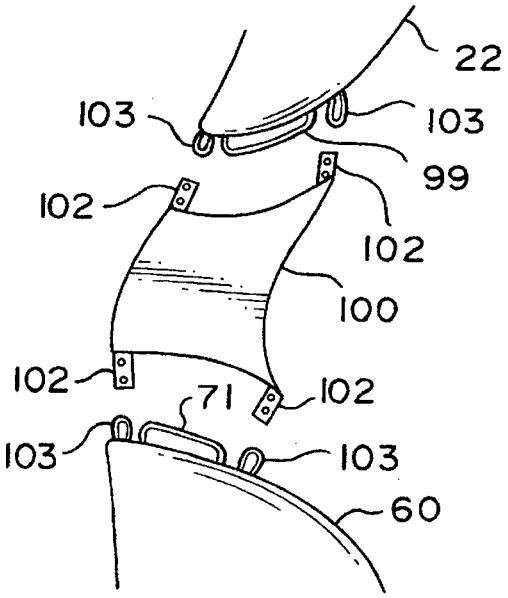
FIG. 12 is an enlarged, exploded view of a portion of FIG. 11 and showing the alternative pillow connecting structure in detail.

An alternative to flexible flaps 73 and 75 may be seen in FIGS. 11 and 12. In FIG. 11, support pillows 22 and 60 are releasably connected via a separate and distinct piece of fabric 100. In FIG. 12, which is an exploded view of FIG. 11, it can be seen that separate and distinct piece of fabric 100 is releasably fastened to abdominal support 22 and leg support 60 by inserting tabs 102 through loops 103, which are sewn into the covers of both abdominal support 22 and leg support 60. Once inserted through loops 103, the tabs, which have releasable fasteners attached to them, are releasably fastened by doubling back on themselves and fastening to themselves. Once this is accomplished, abdominal support 22 is effectively joined to leg support 60 via separate and distinct piece of fabric 100.

The present invention, described above, relates to a support pillow assembly. Features of the present invention are recited in the appended claims. The drawings contained herein necessarily depict structural features and embodiments of the support pillow assembly, useful in the practice of the present invention.

It will be appreciated by those skilled in the art that the support pillow assembly in accordance with the present invention can be practiced in various alternate forms and configurations. Further, the previous detailed descriptions of the preferred embodiments of the present invention are presented for purposes of clarity of understanding only, and no unnecessary limitations should be implied therefrom. Finally, all appropriate mechanical and functional equivalents to the above, which may be obvious to those skilled in the arts pertaining thereto, are considered to be encompassed within the claims of the present invention.

What is claimed is:

1. A support pillow assembly usable to aid in the support of a person reclining on his side, said support pillow assembly comprising:

an abdominal support having a generally crescent shape defined by a thin arcuate concave inner edge and a thick arcuate convex outer edge with two major faces, each said major face residing in substantially a single plane and each having substantially the same configuration and being convergent from said outer edge to said inner edge, said two major faces being generally symmetrical to each other about a midplane of said abdominal support extending between said inner edge and said outer edge and extending between the planes of said two major faces, said abdominal support being structured to be positioned between a user's abdomen and a support surface supporting the user while reclining on his side with said thin arcuate concave inner edge being receivable along its length underneath a user's abdomen;

a leg support positionable between a user's legs and extending between thigh and calf portions of a user's legs, said leg support being structured to support a user's legs in a spaced-apart configuration while a user is reclining on his side, said leg support being generally C-shaped in plan and being defined by a concave arcuate rear edge and a convex arcuate front edge, with two side faces extending between said rear edge and said front edge, and by an upper edge area locatable between a user's thighs and a lower edge area locatable between a user's calves, said side faces being gradually convergent toward said upper and lower edges; and means releasably connecting said abdominal support and said leg support, said abdominal support and said leg support being usable in concert and separately, said abdominal support and said leg support being spaced apart from each other by said connecting means when said abdominal support and said leg support are used in concert.

2. The support pillow assembly of claim 1, wherein said abdominal support includes a foam body and a fabric cover encapsulating said foam body, and wherein said leg support is a unitary resilient body with a fabric covering fitting around said resilient body.

3. The support pillow assembly of claim 1, wherein said connecting means includes a first flexible flap extending from said abdominal support, and a second flexible flap extending from said leg support.

4. The support pillow assembly of claim 3, wherein said connecting means further includes mating releasable fasteners carried by said first and second flexible flaps.

5. The support pillow assembly of claim 1 further including a first set of support pedestals projecting in opposite directions from said side faces of said leg support at an intermediate point along said arcuate front edge, and a second set of support pedestals projecting in opposite directions from said side faces of said leg support at an intermediate point along said arcuate rear edge.

6. A support pillow assembly usable to aid in the support of a person reclining on his side, said support pillow assembly comprising:

an abdominal support having a generally crescent shape in plan and a wedge shape in elevation and further having a relatively thin arcuate concave edge adapted to be positioned on a support surface supporting the user and in engagement with the user's abdomen, and a relatively thick arcuate convex edge adapted to extend upwardly from the support surface;

a leg support positionable between a user's legs and having a thigh support pillow and a calf support pillow, said thigh and calf support pillows being joined together to form said leg support, said thigh support pillow including a first resilient body with a first fabric cover, said calf support pillow including a second resilient body with a second fabric cover; and a flexible connection between said thigh support pillow and said calf support pillow, said flexible connection including a first flexible flap extending from said first fabric cover, and a second flexible flap extending from said second fabric cover.

7. The support pillow assembly of claim 6 wherein said flexible connection further includes mating releasable fasteners carried by said first and second flexible flaps.

8. The support pillow assembly of claim 6 wherein each of said thigh support pillow and said calf support pillow has two opposed, concave arcuate side surfaces which conform to the surfaces of a person's thighs and calves.

* * * * *